United States Patent [19]

Fann et al.

[11] Patent Number: 4,711,477

[45] Date of Patent: Dec. 8, 1987

[54] DUPLEX LATCH BOLT MECHANISM

[75] Inventors: Yaw-Shin Fann; Rong-Faa Wu, both of Chia-Yi, Taiwan

[73] Assignee: Tong Lung Metal Industry Co., Ltd., Chia-Yi, Taiwan

[21] Appl. No.: 817,422

[22] Filed: Jan. 7, 1986

[51] Int. Cl.[4] ..... E05C 1/16

[52] U.S. Cl. ..... 292/169.14; 292/337; 292/DIG. 60

[58] Field of Search ..... 292/337, DIG. 60, 1, 292/169.14, 169.15, 169.16, 169.17

[56] References Cited

U.S. PATENT DOCUMENTS 4,593,542 6/1986 Rolondi et al. ..... 292/DIG. 60 X

FOREIGN PATENT DOCUMENTS 1514331 1/1968 France ..... 292/169.14

*Primary Examiner*—Richard E. Moore

[57] ABSTRACT

The mechanism is used with a latch-bolt unit (including a latch-bolt head) and a latch-handle assembly, for installation in a door. The novel mechanism includes a retracting member (connected to retract the latch-bolt head), with two different sets of extracting teeth to accommodate two different standard door-lock backset configurations of standard commercial doors. A connecting device, made up of first and second coupling members as well as a movable configuration-selector plate, is connected at the rear of the latch-bolt unit. The connecting device has two different sets of screw openings and clearing spaces. Its selector plate selectively effectuates either of these two different sets of connecting points, corresponding to the two standard backsets. The selector plate is thus used to adjust the latch-bolt mechanism quickly and easily, to accommodate the preferred door-lock backset—without any modification such as cutting or bending. The selector plate provides a telescoping action, so that the connecting device does not extend into the door substantially beyond the latch-bolt handle assembly; consequently the door-edge bored hole need not be any deeper than necessary. The telescoping action is an exclusively linear, one-stage adjustment motion.

14 Claims, 15 Drawing Figures

DUPLEX LATCH BOLT MECHANISM

BACKGROUND

1. Field of the Invention

This invention relates generally to latch-bolt mechanisms, and more particularly to a duplex latch-bolt mechanism that can be adapted to any door fitting arrangement by mere adjustment—i.e., without requiring any mechanical modification (drilling, cutting or bending).

2. Prior Art

At present there are two kinds of backset configurations in the structure of traditional latch-bolt mechanisms—namely, a 2⅜ inch type and a 2¾ inch type. In order to meet the configuration requirements of these two types of latch-bolt mechanism, two types of door locks are produced.

As ordinary consumers, however, are unaware of this situation, a great deal of inconvenience is caused in the installation of door locks; different latch-bolt mechanisms are required by different lock-fitting arrangements of doors.

Moreover, different molding sets have to be prepared by the lock manufacturers for producing the different latch-bolt mechanisms, resulting in increased manufacturing costs. Also, it is inconvenient for lock dealers to prepare the different parts lists and storage spaces to put the different latch-bolt mechanisms on sale.

SUMMARY OF THE DISCLOSURE

It is accordingly a primary object of this invention to provide a duplex latch-bolt mechanism, for use with a latch-bolt unit, in which extracting fittings are placed at two different locations to accommodate both of the different standard lock configurations.

It is another object of this invention to provide a duplex latch-bolt mechanism with a connecting device wherein two different sets of coupling features—and a selector for determining which set is operative—are provided for accommodating either backset configuration, in conjunction with the latch-bolt unit.

It is still another object of this invention to provide a duplex latch-bolt mechanism with a unique transfer member disposed in a latch-bolt handle assembly for cooperation with the latch-bolt unit and the connecting device, to perform an unblocking function.

These and other objects are achieved by our invention. It is a duplex latch-bolt mechanism, for use with a manually operated latch-handle assembly.

Such a latch-handle assembly includes a handle, a latch-bolt actuator and at least one mounting element. The latch-handle assembly is adapted to mount in one or more transverse apertures formed in a door to receive the actuator and mounting element, using either of two standard backsets.

In general, a commercial latch-handle assembly will be found to have two or more mounting elements—usually internally threaded pillars or "cylindrical nuts," which parallel the generally central latch-bolt actuator at the same height, and accordingly pass through apertures both "forward" (closer to the edge of the door) and "rearward" from the latch-bolt actuator. For present purposes, however, it will be convenient to conceptualize the device as having one mounting element of particular interest, namely that which is "rearward" (further from the edge of the door) from the latch-bolt actuator.

The latch-bolt mechanism of our invention is also for use with a latch-bolt case that has a rear end, and that is adapted to mount in a longitudinal bore formed in the edge of such a door. Such a longitudinal bore communicates with the transverse apertures in which the latch-handle assembly is mounted.

The latch-bolt mechanism also is for use with a latch-bolt unit that is installed in the case. The latch-bolt mechanism includes a bolt head and a retractor lever.

For some purposes the latch-bolt mechanism of our invention can be fairly regarded as operating in the context or environment formed by the door, handle assembly, case and latch-bolt unit. Thus certain of our appended claims cover the latch-bolt mechanism alone.

Yet it is also reasonable to regard our invention as encompassing the latch-bolt unit, or that unit and the case—or the unit, the case and the handle assembly as well. Thus others of our appended claims cover these other elements in combination with the latch-bolt mechanism.

Our invention includes some means for retracting the latch-bolt head in response to the operation of the latch handle. For purposes of generality of expression, we shall refer to these as the "retracting means."

The retracting means have a front portion that is movably disposed in the latch-bolt case, and is engaged with the retractor lever. The retracting means also have a rear portion that is adapted for operative engagement with the latch-bolt actuator, which as previously mentioned forms a part of the latch-handle assembly.

The rear portion of the retracting means is so adapted at not just one but two locations longitudinally on the rear portion. These two locations are selectable by a user of the mechanism.

Our invention also includes a connecting device, appended at the rear end of the latch-bolt case. The connecting device forms a track for longitudinal motion of the retracting means.

In addition the connecting device has some means for effecting or facilitating access of the actuator to the retracting means. Such access is needed for operative engagement of the actuator with the retracting means—at either of the two selectable locations.

Once again for purposes of generality, these means for effecting access will be called the "access means." Typically (but not necessarily) they will consist simply of clearing apertures in the connecting device, aligned with the engagement-adapted locations on the retracting means.

The connecting device also includes some means for defining two positions longitudinally relative to the door edge—and for receiving the latch-handle assembly mounting element at either of the two positions. For reasons which will become apparent, these means will be designated either the "telescoping means" or the "defining-and-receiving means."

The telescoping or defining-and-receiving means operate to stabilize the connecting device with respect to the latch-handle assembly, and thus with respect to the door.

The two selectable locations on the rear portion of the retracting means are mutually spaced apart longitudinally by a distance substantially equal to the difference between the two standard backsets. Similarly the two selectable positions defined by the telescoping or defining-and-receiving means are mutually spaced apart longitudinally by the same distance.

Now in a preferred embodiment of our invention, the defining-and-receiving means are accurately denominated "telescoping means" for the following reason.

When defining and receiving at the selectable position that is relatively closer to the door edge—e.g., for a 2⅜ inch backset—the telescoping means are collapsed longitudinally, so that the connecting device after installation in the door does not extend substantially beyond the mounting element (particularly the "rearward" mounting element).

On the other hand, when defining and receiving at the selectable position that is relatively further from the door edge—e.g., for a 2¾ inch backset—the telescoping means are extended longitudinally so that the connecting device after installation reaches to the mounting element.

By virtue of these arrangements, when this particular preferred embodiment of our invention is employed, a door can be prepared for installation of the entire latch (including the latch-bolt mechanism, case, and unit, and including the latch-handle assembly), using either of the standard backsets, by forming a longitudinal bore that does not extend substantially beyond the mounting element or the transverse apertures.

Moreover, this preparation can be accomplished without presupposing any mechanical modification of the latch-bolt mechanism—and without any adjustment or modification of the case, unit or assembly.

Also in a preferred embodiment of our invention, the defining-and-receiving means include a configuration-selector plate, movably mounted to the connecting device. This plate by its motion adapts the connecting device for use with either standard backset.

In particular, this motion of the selector plate is exclusively longitudinal, and is a single-stage (i.e., not compound) motion. The benefit of such a simple rectilinear adjustment motion in terms of simplicity for the user is considerable.

The connecting device limits the exclusively linear or longitudinal motion of the configuration-selector plate to an overall travel that is substantially equal to the distance between the two standard backsets.

The overall result is that the single-stage, exclusively longitudinal motion of the configuration-selector plate adapts the latch-bolt mechanism for installation using either of the standard backsets—once again without any mechanism modification of the mechanism, and further without any adjustment or modification of the latch-bolt unit, latch-bolt case, or latch-handle assembly.

All of the foregoing operational principles and advantages of the present invention will be more fully appreciated upon conideration of the following detailed description, with reference to the appended drawings, of which:

DETAILED DESCRIPTION OF THE PREFERRED EMBODIMENTS

Figure 1:
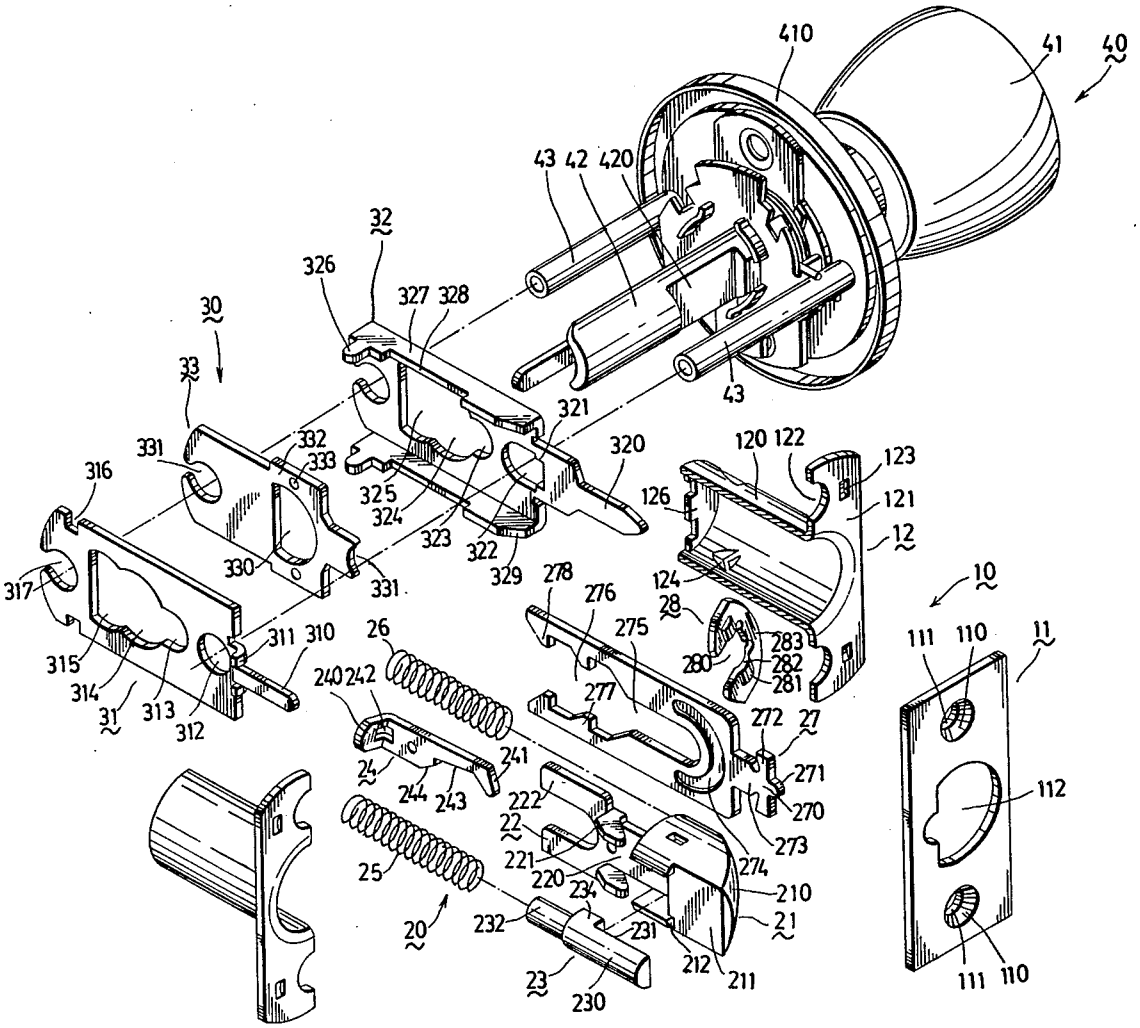
FIG. 1 is a perspective and exploded view of a preferred embodiment of a duplex latch-bolt mechanism with related hardware according to this inventionn.
Figure 8:
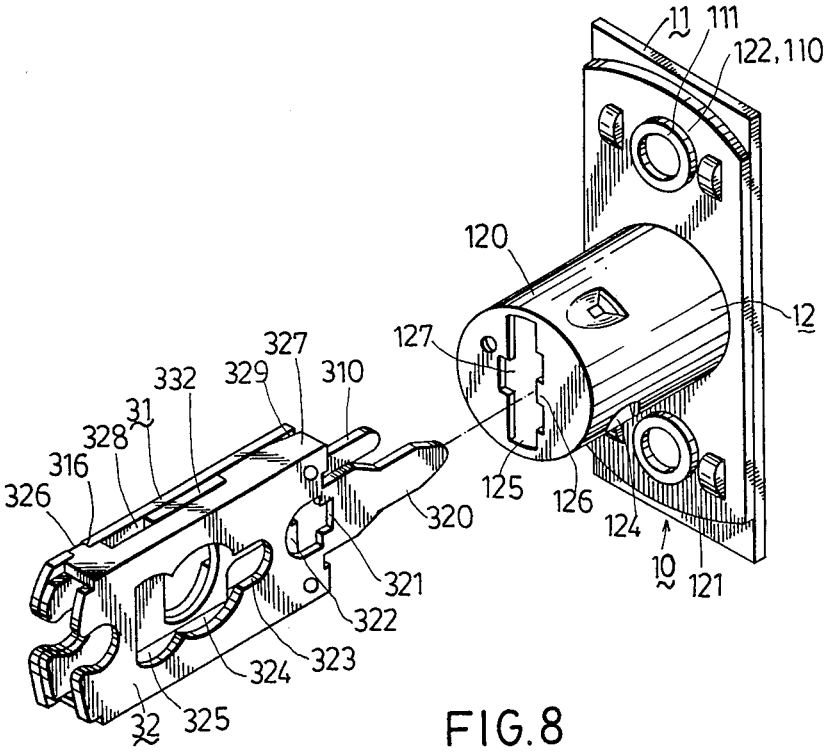
FIG. 8 is a perspective view of an assembled outer casing structure and connecting device of the preferred embodiment shown in FIG. 1.
Figure 9:
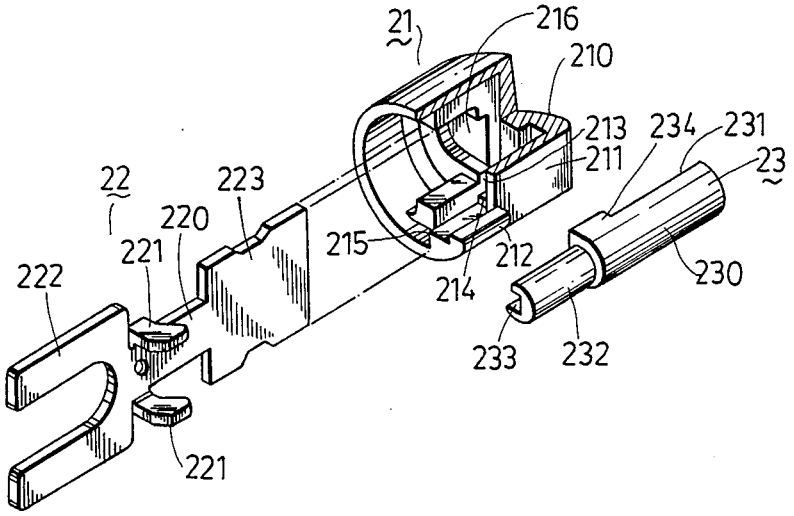
FIG. 9 is a partial cutaway and perspective view of a latch-bolt unit of the preferred embodiment shown in FIG. 1.

Referring to FIGS. 1, 8 and 9, the preferred embodiment of a duplex latch-bolt mechanism according to this invention includes in general an outer casing structure 10, a latch-bolt unit 20, a connecting device 30 and a latch-bolt handle assembly 40.

The outer casing structure 10 includes a front faceplate 11 and a latch bolt case 12. The front faceplate 11 is, as usual, formed in a rectangular shape with a pair of screw openings 110 at its upper and lower ends. A latch-bolt head opening 112 together with a dead-latch bolt opening 113 is provided in the middle. Extending rearward from each of the screw openings 110 is an annular flange 111.

The latch-bolt case 12 includes a cylindrical casing body 120 with a mounting flange plate 121 at its front end having a pair of screw openings 122, and adjacent to each screw opening a plurality of protuberances 123. The case 12 also includes a pair of positioning abutments 124 separately located in the casing body 120, and an accommodating slot 125 (best seen in FIG. 8), vertically formed at the rear end of the body 120. Defined in the slot 125 are a protrusion 126 and a recess 127.

As seen in FIG. 8, the mounting flange plate 121 is coupled with the front faceplate 11 through the annular flanges 111. These flanges are fastened (as by welding)

in the screw openings 122 of the mounting flange plate 121.

As shown in FIG. 1, the latch-bolt unit 20 is made up of a latch-bolt head 21, a latch-bolt extension member 22, a dead-latch bolt 23, a latch dog 24, a first spring 25, a second spring 26, a retracting member 27 and a retractor lever 28.

The front portion of the latch-bolt head 21 has an inclined curved surface 210 on one side and a flat surface 211 on the other. Two positioning shoulder 212 are located at the rear end of the flat surface 211. As best shown in FIG. 9, the latch-bolt head 21 is hollow; formed in it are a latch-dog receiving groove 213, an abutment surface 214, an extension-member positioning slot 215 and a spring chamber 216.

Referring to FIGS. 1 and 9, the extension member 22 is a plate-like piece with a neck portion 220 in the middle, a pair of retracting tabs 221 located at an angle with its opposing sides, a forked guide portion 222 at the rear end and a coupling portion 223 at the front end. The coupling portion 223 is provided for insertion into the extension-member positioning slot 215 in the latch-bolt head 231, to connect the coupling portion 223 to the head 231.

Referring to FIGS. 1, 3, 9 and 10, the dead-latch bolt 23 includes, as usual, a hemicylindrical bar 230 with a flat contacting surface 231 along its front portion, a shoulder 234 at the rear end of the flat contacting surface 231, and at its rear portion of cylindrical steam 232 with a longitudinal trough 233 along its side—all for movably coupling with the latch-bolt head 21.

As shown in FIG. 1, the latch dog 24 includes a propping flange 240 at its rear end, a pin hole 242 located at an angled portion of the propping flange 240, an inclined surface 241 at its front end, a transverse notch 243 and a guide slope 244 located behind the inclined surface 241. The guide slope 244 is for disposition in the latch-dog receiving groove 213 of the latch-bolt head 21, with the inclined surface 241 positioned against the abutment surface 214 (as shown in FIG. 10).

The first spring 25, a coil-compression type, encircles the cylindrical stem 232 of the dead-latch bolt 23. The dead-latch bolt is movably disposed alongside the neck portion 220 of the latch-bolt extension member 22, generally between the retracting tabs 221—with the flat contact surface 231 abutting the flat surface 211 of the latch-bolt head 21.

Figure 10:
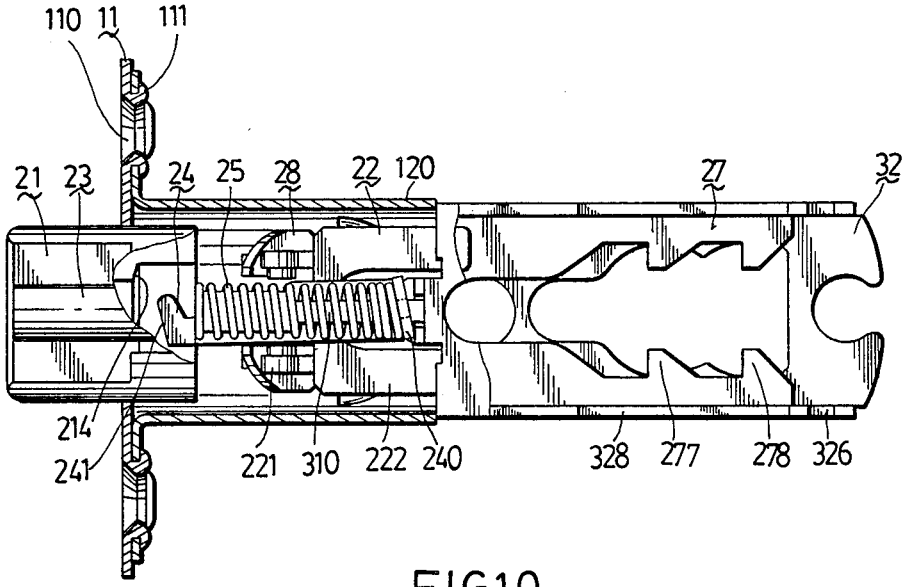
FIG. 10 is a partial sectional and elevational view of the preferred embodiment installed in a door (which is in open condition) with its latch-bolt head and dead-latch bolt fully extended thereat.
Figure 11:
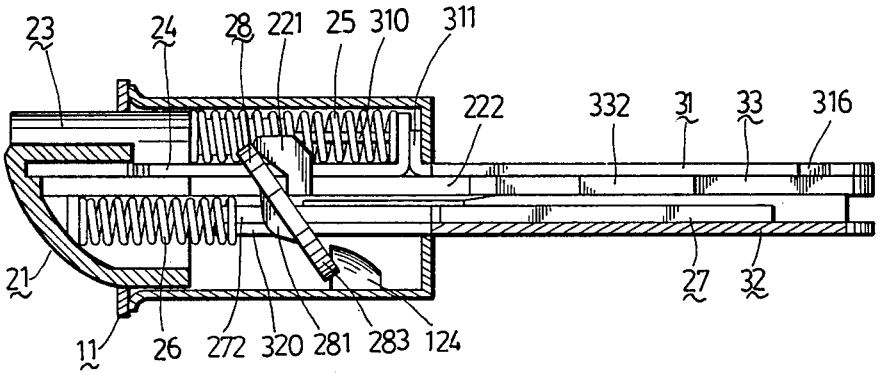
FIG. 11 is a side sectional view of the preferred embodiment shown in FIG. 10.

The rear end of the spring 25 is engaged with the propping flange 240 of the latch dog 24 (as shown in FIG. 10), while the second spring 26, which is shorter than the first spring 25, is disposed in the spring chamber 216 of the latch-bolt head 21 (as shown in FIG. 11).

Referring to FIG. 1, the bolt retracting member 27 is a plate-like piece, with a crosshead 270 consisting of a crossarm 272 and a protuberance 271 at its front end. The retracting member 27 also has a neck portion 273 behind the crossarm 272, a forked portion at its rear end, an arcuate stiffening rib 274 provided on the connecting part of the forked portion, and an elongated open section 275 and clearing opening 276 respectively defined in the forked portion.

In addition, symmetrically formed on the inner edge of the clearing opening 276 are a pair of forward extraction teeth 277 and a pair of rearward extraction teeth 278. A clearance of about ten millimeters is provided between the two pairs of extraction teeth 277 and 278.

The retractor lever 28 is a C-shaped flat piece with an opening 280 in the middle, a pair of bulges 281 and a pair of abutment surfaces 282 separately located just above and below the opening 280. The lever 28 also has a side 283, at the end of the opening 280, that is engaged with the neck portion 273 of the retracting member 27.

The connecting device 30, as shown in FIG. 1, includes in combination a first coupling member 31, a second coupling member 32 and a configuration-selector plate or displacement plate 33.

The first coupling member 31 is a flat plate having a mounting pin 310 extending from its front end, a lateral anchoring tab 311 angularly located at each shoulder of the mounting pin 310, and a forward screw opening 312 and a partially defined rearward screw opening 313—both near the front end of the first coupling member 31. The first coupling member also has a forward clearing space 314 and a rearward clearing space 315—both near the middle—and a pair of assembly-locking tab notches 316 and a tail screw opening 317, both at the rear end.

The second coupling member 32 too originates as a plate-like piece, through it is highly formed as will be seen. The second coupling member 32 has a prong 320 at the front end.

Also located in the second coupling member 32 are both a forward screw opening 322 and a partially defined rearward screw opening 123, and both a forward clearing space 324 and a rearward clearing space 325. These openings and spaces respectively correspond to the similarly named openings and spaces of the first coupling member 31.

In addition, near the front of the second coupling member 32, adjoining the forward screw opening 322, is a coupling notch 321. Formed respectively along the top and bottom edges of the second coupling member 32 are two outwardly standing side flanges 327.

Each flange has a displacement notch 328 in its outer edge, an oblique bevel 329 cut at the front end, and a pair of lateral assembly-locking tabs 326 extending outwardly from the rear end.

The selector plate or displacement plate 33 is also a flat plate with a partially defined screw opening 331 at each end; and a clearing space 330 in the forward portion, corresponding to both the forward clearing spaces 314, 324 and the rearward clearing spaces 315, 325 of the first and second coupling members 31 and 32. The selector plate 33 also has a pair of positioning tabs 332 and a pair of protuberances 333 therefrom, respectively located above and below the clearing space 330.

When the first and second coupled members are connected together, the selector or displacement plate 33 is movably sandwiched between them, as can best be seen in FIG. 8. The positioning tabs 332 are separately received in the displacement notches 328 of the second coupling member 32, to guide the adjustment of the selector or displacement plate 33 therein.

Referring to FIG. 1, the latch-handle assembly 40 is, as usual, formed of a doorknob 41 movably connected to a coupling disc 410, a curved transfer member or bolt actuator 42 with a flat stiffening and actuating portion 420 at its root end. The actuator is fixed to the handle grip 41 through the coupling disc 410. Two cylindrical nuts 43 are also secured to the coupling disc 410.

Figure 4:
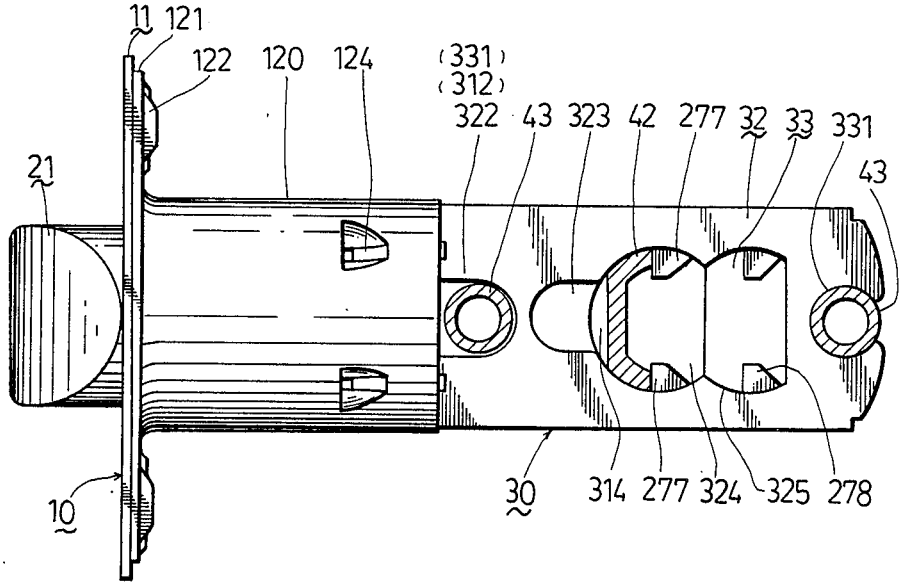
FIG. 4 is a partial sectional and elevational view of the assembled preferred embodiment, used in a 2⅜ inch backset configuration.

As shown in FIG. 4, the latch-handle assembly 40 can be screw-connected to the assembly connecting device 30, with the curved transfer member 42 rotatably positioned in the forward clearing spaces 314 and 324—as well as the clearing space 330 aligned therewith. This is the arrangement when the latch-bolt mechanism of this invention is used as a 2⅜ inch type. In this arrangement the cylindrical nuts 43 are respectively screw-connected in the forward screw openings 312 and 322 of the first and second coupling members 31 and 32.

Figure 5:
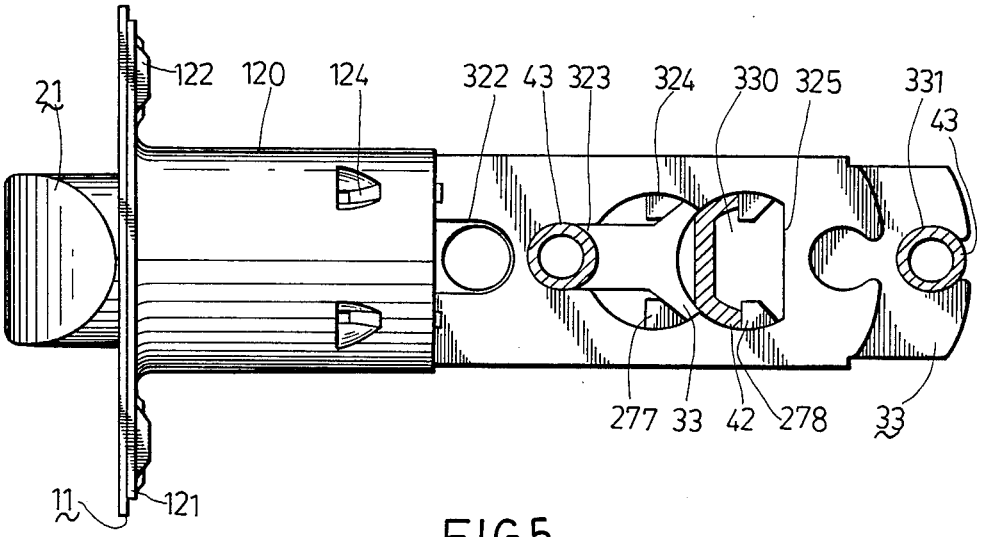
FIG. 5 is a partial sectional and elevational view of the assembled preferred embodiment, used in a 2¾ inch backset configuration.

It will be appreciated that when the latch-bolt mechanism of this invention is used as a 2⅜ inch type, as shown in FIG. 5, the curved transfer member 42 will be located instead in the rearward clearing spaces 315, 325 and the clearing space 330 of the displacement plate 33. Similarly, the selector plate 33 is shifted backward to select the 2¾ inch configuration, so that the cylindrical nuts 43 are instead respectively situated in the rearward screw openings 313 and 323 and the screw opening 331 at the lower end of the displacement plate 33.

Assembly of the preferred embodiment proceeds as follows. Referring to FIGS. 1, 2, 8, 9 and 11, the first coupling member 31 is connected to the casing body 120 by inserting the mounting pin 310 through the recess 127 in the slot 125, at the rear of the body 120, and engaging the anchoring tabs 311 with the inside of the casing body rear wall (FIG. 11).

Within the casing body 120, the mounting pin 310 also passes through the pin hole 240 of the latch dog 24, and is located in the longitudinal trough 233 of the dead-latch bolt 23. In other words, the latch dog 24 and dead-latch bolt 23 both ride on the mounting pin 310.

The prong 320 of the second coupling member 32 is inserted into the casing body 120 through the accommodating slot 125 unit the oblique bevel 329 is positioned in the accommodating slot 125. Then the connecting device 30 is aligned with the cylindrical casing body 120 so that the coupling notch 321 engages the protrusion 126.

Figure 2:
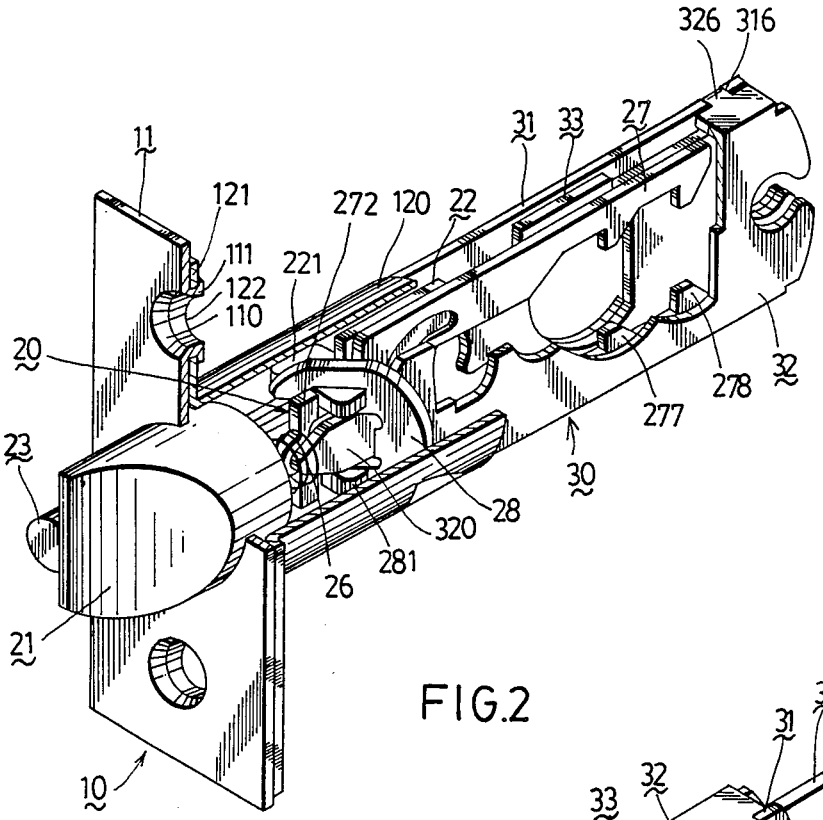
FIG. 2 is a partial cutaway and perspective view of the preferred embodiment of FIG. 1, used in a 2⅜ inch backset configuration.

The selector or displacement plate 33 is sandwiched between the first and second coupling members 31 and 32. The assembly-locking tabs 326 extending from the side flanges 327 of the first coupling member 31 are firmly secured in the assembly-locking-tab notches 316 of the second coupling member 32 as shown in FIG. 2, and are bent over on the outside of the second coupling member 31.

The two coupling members 31 and 32 are thus interlocked at their front ends by the slot 125 and recess 127 in the casing body 120, and at their rear ends by the assembly-locking tabs 326 and notches 316. The two coupling members thus form a tall, narrow cage or guideway—or at least a track—within or along which the selector plate 30 and the rearward portions of the retracting member 27 can slide longitudinally.

Engagement of the positioning tabs 332 with the ends of the displacement notches 328 limits the forward and rearward travel of the selector plate 30.

Referring to FIGS. 1, 2, 3 and 9, the coupling portion 223 of the latch-bolt extension member 22 is installed in the positioning slot 215 of the latch-bolt head 21, and the contact surface 231 of the dead-latch bolt 23 is located at the flat surface 211 with the shoulder 234 butting the rear end of the flat surface 211 of the latch-bolt head 21.

Figure 3:
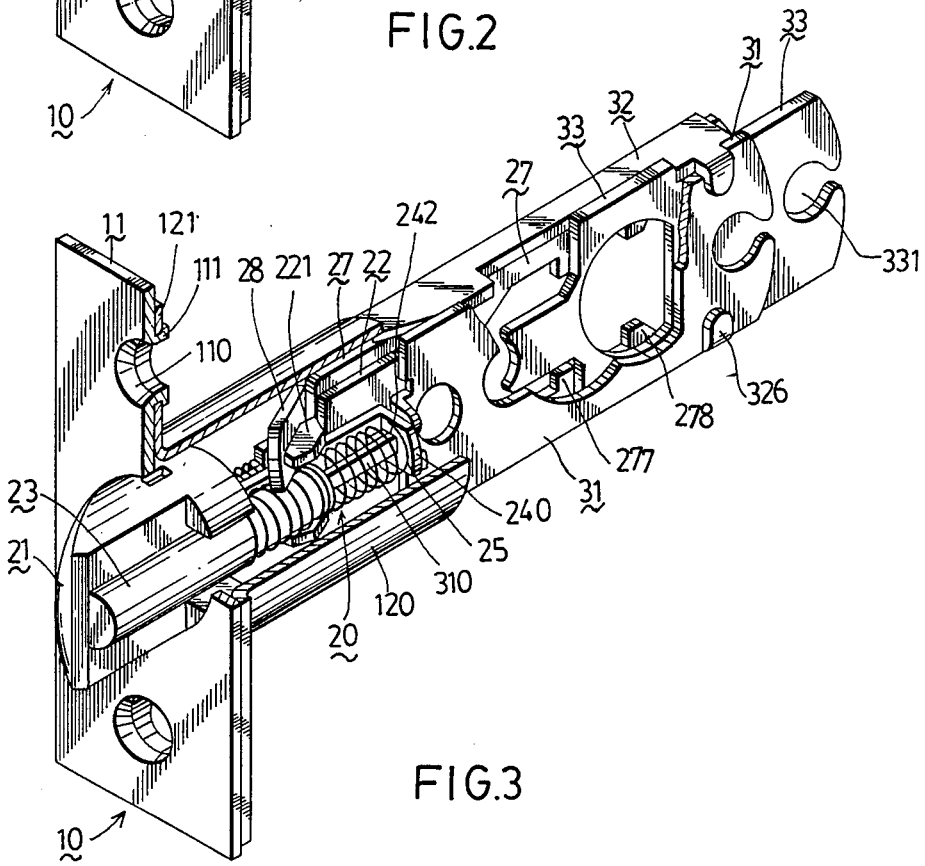
FIG. 3 is a partial cutaway and perspective view of the preferred embodiment of FIG. 1, used in a 2¾ inch backset configuration.

As can best be seen in FIG. 3, the first spring 25 encircles the cylindrical stem 232 of the dead-latch bolt 23, which is located on the flat surface 211 of the latch-bolt head 231 are described above. The latch dog 24 is movably positioned in the receiving groove 213, adjacent to the first spring 25, so that when the latch-dog propping flange 240 is shifted to the right (as viewed from the plate 11) its inclined surface 241 with be propped against the abutment surface 214 of the latch-bolt head 21.

Figure 13:
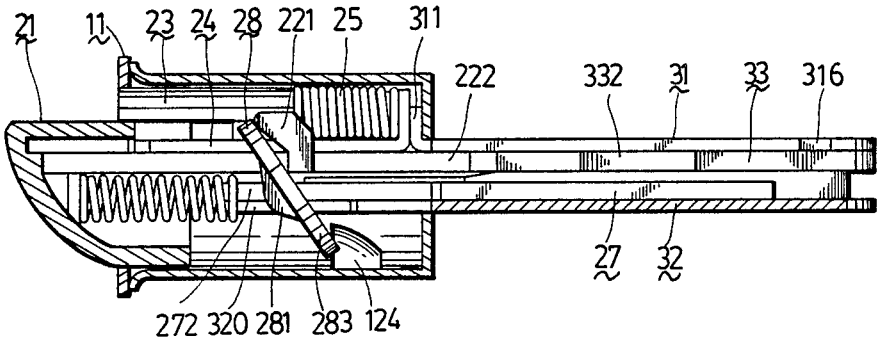
FIG. 13 is a side sectional view of the preferred embodiment shown in FIG. 12.

The second spring 26 is disposed in the spring chamber 216 of the latch-bolt head 21, and the retracting member 27 is placed close to the latch-bolt extension member 22 by being pushed toward the latch-bolt head 21. In this way the protuberance 271 of the crosshead 270 is positioned within the rear end of the second spring 26, and the crossarm 272 abuts the rear end of the second spring 26 (as shown in FIG. 13). In other words, the shaped crosshead 270 forms a rear anchor for the spring 26.

After the above installation sequence, the retractor lever 28 is obliquely disposed on the retracting member 27 (as shown in FIGS. 2 and 3) with its opening 280 partially surrounding the neck portion 273 and extending over the front side of the retracting tabs 221 of the latch-bolt extension member 22, and with the bulges 281 respectively abutting (FIG. 15) the crossarm 272 of the retracting member 27.

The assembly latch-bolt unit 20 is installed in the cylindrical casing body 120 with the latch-bolt head 231 extending from the front of the front faceplate 11 (which is fixedly connected to the flange plate 121 as previously described), through the latch-bolt opening 112; and with the dead-latch bolt 23 in the dead-latch bolt opening 113.

The fulcrum side 283 of the retractor lever 28 engages with positioning abutments 124 formed inside the casing body 120. In addition, when the installation of the latch-bolt unit 20 in the latch-bolt casing structure 10 is completed, the mounting pint 310 of the first coupling member is located in the longitudinal trough 233 of the dead-latch bolt 23 through the pin hole 242 of the latch dog 24.

Further, the prong 320 of the second coupling member is also situated in the second spring 267 through the opening 280 of the retractor lever 28 (as shown in FIGS. 2 and 3). After the assembly of the preferred embodiment is completed, the extraction teeth 277 and 278 of the retracting member 27 are positioned against the selector/displacement plate 33. In one longitudinal setting of the selector plate 33, the forward extraction teeth 277 are located close to the clearing opening 330 of the selector plate 33 as shown in FIG. 2.

During installation in a door, if the preferred embodiment is used as a 2⅜ inch type, the selector or displacement plate 33 is positioned forward. The front edges of its positionings tabs 332 locate positively against the front ends of the displacement notches 328 in the second coupling member 32. The clearing space 330 is aligned with the forward clearing spaces 314 and 324 of the first and second coupling members 31 and 32, as in FIG. 2.

In this configuration, the curved transfer member 42 of the latch-handle assembly 40 is movably positioned in the forward clearing spaces 314 and 324 as well as in the clearing space 330 aligned thereat, with the flat stiffening and actuating portion 420 engaged with the forward extraction teeth 277.

The cylindrical nuts 43 are separately secured in the forward screw openings 322 and 312, as well as in the front screw opening 331 of the selector/displacement plate 33 aligned therewith; and in the tail screw opening 317 in the first coupling member 31 and the tail screw opening (unnumbered) in the second coupling member 32, as well as the rear end screw opening 331 in the selector/displacement plate 33 aligned therewith—as shown in FIG. 4.

Operations of the preferred embodiment installed in a door (not shown) are as follows.

Figure 14:
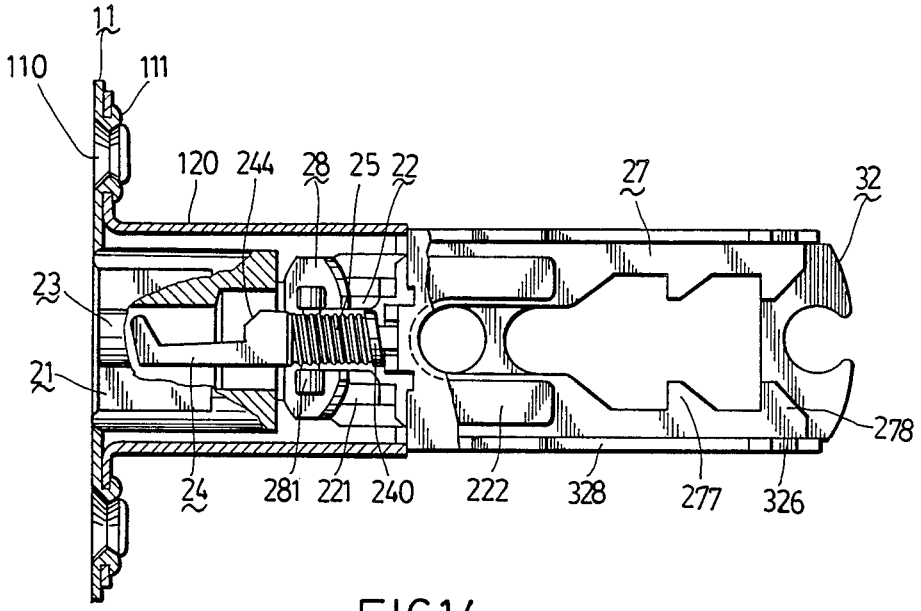
FIG. 14 is a partial sectional and perspective view of the preferred embodiment installed in a door with the latch-bolt head and the dead-latch bolt both retracted (that is, when the doorknob is rotated to open the door during an unlocking operation).
Figure 15:
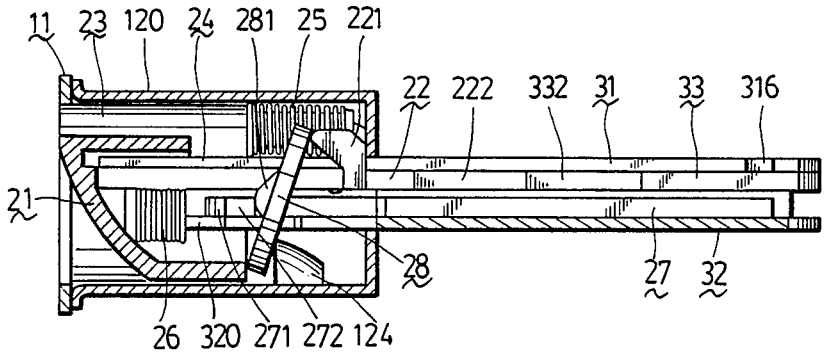
FIG. 15 is a side sectional view of the preferred embodiment shown in FIG. 14.

(1) In normal condition as shown in FIGS. 10 and 11, the latch-bolt head 21 and the dead-latch bolt 23 are extended. Upon rotation of the latch handle grip or doorknob 41, the curved transfer member or actuator 42 that is engaged with the forward extraction teeth 277 is moved to drive the retracting member 27 backward from the actuator 42. In turn the crossarm 272 of the retracting member 27 causes an angular displacement of the retractor lever 28. This rotation of the lever 28 pulls the retracting tabs 221 and thereby the latch-bolt extension member 22 rearward. The latch-bolt head 21, together with the dead-latch bolt 23, is thereby retracted, as shown in FIGS. 14 and 15.

Figure 12:
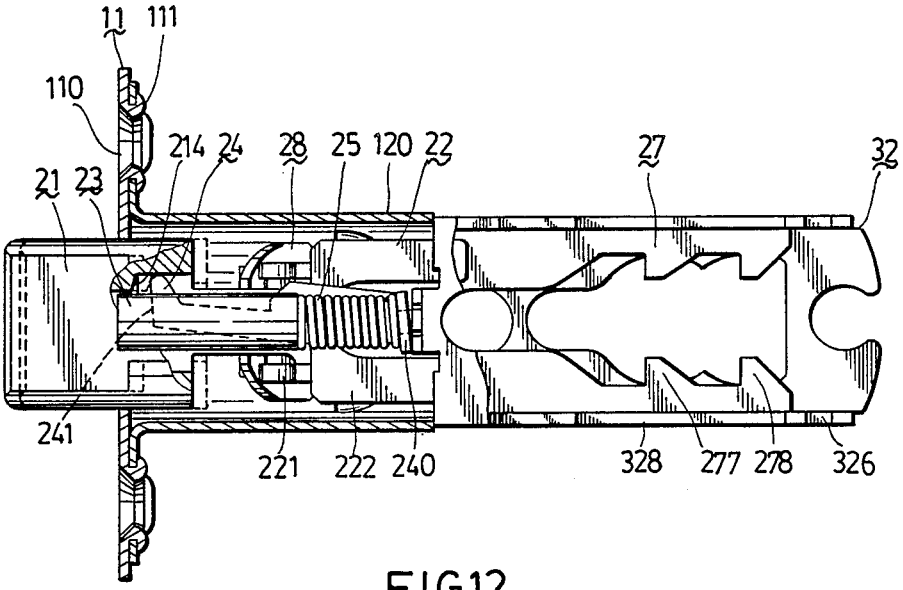
FIG. 12 is a partial sectional and elevational view of the preferred embodiment installed in a door (which is in closed condition) with its latch-bolt head fully extended but its dead-latch bolt retracted.

(2) In the blocking operation as shown in FIGS. 12 and 13, the latch-bolt head 21 is fully extended, but the dead-latch bolt 23—having been "locked"—remains in its retracted position. The resulting expansion force of the first spring 25 compels the abutment flange 240 of the latch dog 24 to shift rightward therefrom (as viewed from the position of the door edge and the plate 11) so that its inclined surface 241 props against the abutment surface 214 of the latch-bolt head 21, effecting the blocking operation therewith.

(3) In the unblocking operation, when the doorknob 41 is rotated, the curved transfer member 43 is turned to drive the front extraction teeth 277 of the extracting member 27 backward. The teeth 277 in turn, acting through the crossarm 272, rotate the retractor lever 28, retracting the latch-bolt head 21 and the dead-latch bolt 23. In the meantime, the abutment surface 282 of the retractor lever 28 urges the latch dog 24 along the guide slope 244 to shift leftward, to perform the unblocking operation as shown in FIGS. 14 and 15.

If the preferred embodiment is used as a $2\frac{3}{4}$ inch backset type, the selector or displacement plate is pulled rearward so that (1) the rear edges of its positioning tabs 332 locate against the rear ends of the displacement notches 328 of the second coupling member 32, and (2) its clearing space 330 aligns with the rearward clearing spaces 315 and 325 of the first and second coupling members 31 and 32 (as shown in FIG. 5).

In this configuration, the curved transfer member 42 is movably positioned in the rearward clearing spaces 315 and 325 as well as in the clearing space 330 aligned therewith. The flat stiffening and actuating portion 420 of the transfer member 42 engages the rearward extracting teeth 278 of the retracting member 27, while the cylindrical nuts 43 are separately secured in the rearward screw openings 313 and 323. The cylindrical nuts are also secured in the rear-end screw opening 331 of the displacement/selector 33, extending from the rear end of the connecting device 30 (as shown in FIG. 3).

Operations of the preferred embodiment for this $2\frac{3}{4}$ inch backset are the same as those described above, except that in the unblocking operation, as shown in FIG. 5, the curved transfer member 42 is operated through the rearward extracting teeth 278 rather than through the forward teeth 277.

Figure 6:
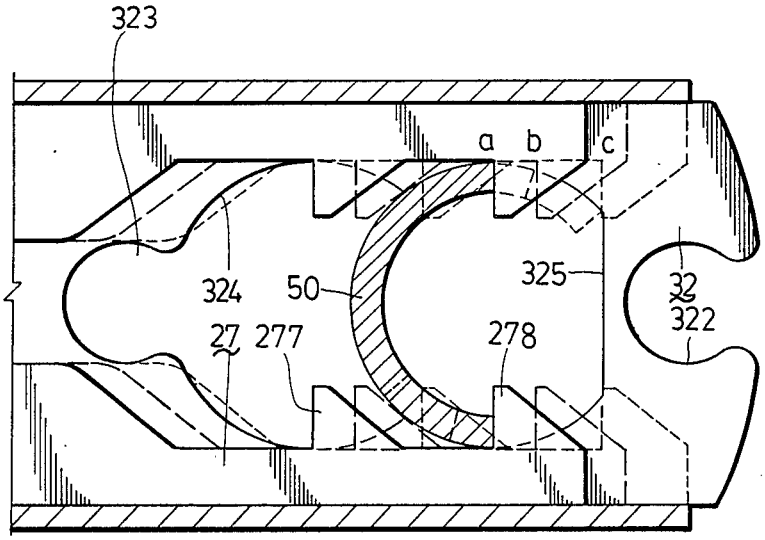
FIG. 6 is an illustrative view of the latch-bolt mechanism of the preferred embodiment when coupled with a traditional curved transfer member or latch-bolt actuator, which is unable to unblock the latch-bolt unit of this invention.
Figure 7:
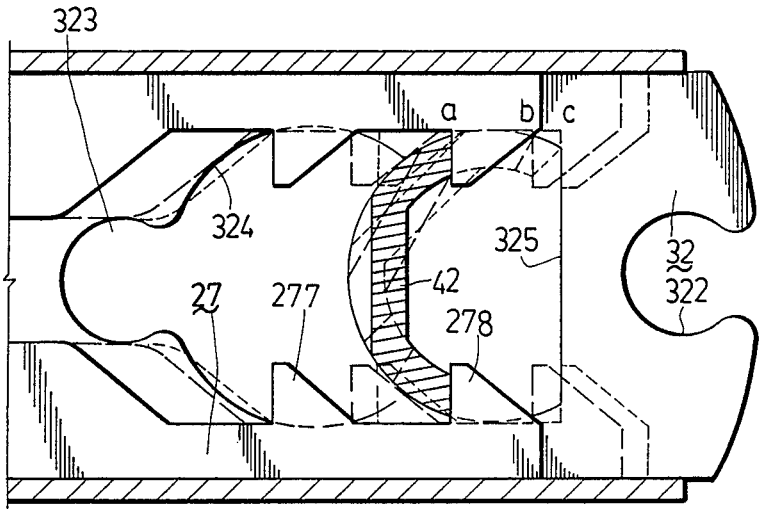
FIG. 7 is an illustrative view of the latch-bolt mechanism of the preferred embodiment when coupled with a unique curved transfer member or latch-bolt actuator for unblocking the latch-bolt unit.

Referring to FIGS. 6 and 7, since the retracting member 27 according to this invention is provided with different extracting teeth 277 and 278 at different locations, a uniquely shaped transfer member in the latch-handle assembly 40 is designed to function with both sets of extracting teeth. The transfer member 42 has a specific curvature and a flat stiffening and actuating portion 420, enabling it to pull the retracting member 27 backward by means of either pair of extracting teeth 277 or 278—thereby completely retracting the latch-both head 21 and dead-latch bolt 23.

In our invention, the mechanical advantage between the retracting member 27 (which rotates the retractor lever 28) and the bolt-head extension member 22 (which is rotated by the lever 28) is determined by the ratio of two distances. One of these is the distance along the lever 28 from the retracting member 27 to the fulcrum—which is formed by the case abutments 124, adjacent to the closed side 283 of the lever 28. The other is the distance along the lever 28 from the extension member 22 to the fulcrum. The respective travels of these two members are related by the same ratio.

In a preferred embodiment of our invention, this ratio is about 1:2. Hence, when the retractor lever 27 is moved backward by about six millimeters, the latch-bolt head 21 is completely retracted to perform the unblocking operation. It is due to these relationships that no conventional transfer member disposed in the latch-handle assembly can work in the preferred embodiment.

FIG. 6 shows a conventional half-round tranfser member 50, engaged with the rear extracting teeth 278 in the rearward clearing spaces 315 and 325, while FIG. 7 shows the transfer member or actuator 42 of the preferred embodiment matched with the same extracting teeth 278.

The solid lines in these two drawings show the transfer members in their respective orientations when the mechanism is quiescent. The broken lines in the same two drawings shown the respective turning tacks of both transfer members or actuators 50 and 42 when the doorknob 41 is rotated.

The successive positions of the rear extracting teeth 278 and the actuators 50 and 42, shown in first solid and then broken lines, are marked a, b and c in both drawings. When the rear extracting teeth 278 reach position c, the retracting member 27 rotates the retractor lever 28 just enough to retract the latch-bolt head 231 and dead-latch bolt 23 completely.

As can be seen in FIG. 6, however, when the doorknob 41 is rotated, the conventional half-round transfer member 50 is able to reach only point b. Its unused round surface blocks further rearward motion of the unused forward extracting teeth 277—thus halting the entire mechanism.

On the other hand, the unique transfer member 42 of the preferred embodiment can be completely matched with both extracting teeth 277 and 278, and thus can be rotated from position a to position c to perform the unblocking operation. Its unused surface, by virtue of being formed with the flattened shape illustrated, clears the usused forward extracting teeth 277 during their rearward motion.

Consequently the flattened shape permits further rearward motion of the retracting member 27 and further operation of the entire mechanism to the fully-retracted condition. In addition, the flattened shape provides structural stiffening, and consequently improved reliability, of the actuator 42.

It will be understood that the foregoing disclosure is intended to be merely exemplary, and not to limit the scope of the invention—which is to be determined by reference to the appended claims.

What is claimed is:

1. A duplex latch-bolt mechanism, for use with a manually operated latch-handle assembly that has a handle, a latch-bolt actuator and at least one mounting element and that is adapted to mount in one or more transverse apertures formed in a door to receive the actuator and mounting element, using either of two standard backsets; and for use with a latch-bolt case that has a rear end, and that is adapted to mount in a longitudinal bore formed in the edge of such a door and communicating with the transverse apertures; and for use with a latch-door unit that is installed in the case and includes a bolt head and a retractor lever; said mechanism comprising:

means for retracting such bolt head in response to operation of such handle, said means having:

a front portion that is movably disposed in such latch-bolt case and engaged with such retractor lever, and a rear portion that is adapted, at two selectable locations longitudinally thereon, for operative engagement with such latch-bolt actuator; and a connecting device appended at the rear end of such latch-bolt case and forming a track for longitudinal motion of the retracting means, and having:

access means for effecting access of such actuator to the retracting means, for operative engagement of such actuator with the retracting means at either of said two selectable locations, and including telescoping means for defining two selectable positions longitudinally relative to such door edge and for receiving such latch-handle assembly mounting element at either of the two positions, to stabilize the connecting device with respect to such latch-handle assembly and such door;

said telescoping means, when defining and receiving at the selectable position that is relatively closer to such door edge, being collapsed longitudinally so that the connecting device after installation does not extend substantially beyond the mounting element;

said telescoping means, when defining and receiving at the selectable position that is relatively further from such door edge, being extended longitudinally so that the connecting device for installation reaches to the mounting element;

the two selectable locations on the rear portion of the retracting means being mutually spaced apart longitudinally by a distance substantially equal to the difference between such two standard backsets; and the two selectable positions defined by the telescoping means being mutually spaced apart longitudinally by the same distance;

whereby such a door can be prepared for installation of the latch-blt mechanism, in conjunction with such latch-bolt case, latch-bolt unit and latch-handle assembly, using either of the standard backsets, by forming such a longitudinal bore that does not extend substantially beyond such transverse apertures, without any mechanical modification of the mechanism and without any adjustment or modification of such case, unit or assembly.

2. A duplex latch-bolt mechanism according to claim 1, wherein:

said retracting means comprise a plate-like member having;

a crosshead at its front end, a neck portion located at the rear end of the crosshead, a forked portion extending rearward from the neck portion, an arcuate stiffening rib provided on a connecting part of the forked portion, an elongated open section defined in the forward part of the forked portion, a clearing opening formed in the open section, and a pair of forward extraction teeth and a pair of rearward extraction teeth symmetrically located on an inner edge of the clearing opening; and said front portion of the retracting means is adapted for engagement with such extractor lever, as aforesaid, by means of said crosshead and said neck portion;

said rear portion of the retracting means is adapted for operative engagement with such actuator, as aforesaid, by either said forward or said rearward pair of extraction teeth selectably.

3. A duplex latch-bolt mechanism according to claim 1, wherein said connecting device comprises:

a first coupling member in the form of a generally flat plate-like piece having:

a mounting pin extending from its front side, a pair of anchoring tabs angularly located one at each side adjacent to a root end of the mounting pin, a forward screw opening and a rearward screw opening respectively provided in its forward portion, a forward clearing space and a rearward clearing space formed in its middle portion, and a pair of assembly-locking-tab notches and a screw opening located at its rear end;

a second coupling member that is a formed plate-like piece having;

a prong at its front end, a forward screw opening together with a coupling slot formed in its forward portion, a rearward screw opening together with a forward clearing space and rearward clearing space provided in its middle portion, all corresponding to the screw openings and clearing spaces of the first coupling member, a pair of outwardly standing flanges, each formed along a respective opposite edge of the second coupling member, a pair of displacement notches located opposed to each other along outer edge of each flange, a pair of outwardly standing assembly-locking tabs located opposed to each other, one at the rear end of the outer edge of each flange, and a pair of oblique bevels located opposed to each other, one cut into a front end of each flange;

said second coupling member being fixedly connected to the first coupling member, by virtue of the assembly-locking tabs of the second member being respectively secured in the assembly-locking-tab notches of the first coupling member; and a configuration-selector plate in the form of a generally flat, plate-like piece having a screw opening provided at its forward and rearward ends, a clearing space formed in its forward portion, corresponding to the forward and rearward clearing spaces of both the first and the second coupling members, and a pair of positioning tabs, each with a protuberance, located one along each of the opposite edges of the selector plate, for sliding motion in the respective displacement notches of the second coupling member, said selector plate being movably sandwiched between the first and the second coupling members;

whereby an extended pattern or a retracted pattern of the connecting device can be conveniently selected through shifting the position of the selector plate for altering configurations.

4. A duplex latch bolt mechanism according to claim 1, further comprising such latch-handle assembly, and wherein:

the latch-handle assembly comprises a generally curved transfer member having said flat stiffening and actuating portion formed near its root for operative engagement with selectably either the forward or rearward extraction teeth of the extracting means;

said flat portion being particularly adapted to clear the forward extraction teeth, over the full range of operation of the extractor lever, when engaged with the rearward extraction teeth.

5. A duplex latch-bolt mechanism, for use with a manually operated latch-handle assembly that has a handle, a latch-bolt actuator and at least one mounting element and that is adapted to mount in a door, using either of two standard backsets; and for use with a latch-bolt case that has a rear end and is also adapted to mount in such a door; and for use with a latch-bolt unit that is installed in the case and includes a bolt head and a retractor lever; said mechanism comprising:

means for retracting such bolt head in response to operation of such handle, said means having:

a front portion that is movably disposed in such latch-bolt case and engaged with such retractor lever, and a rear portion that is adapted, at two selectable locations longitudinally thereon, for operative engagement with such latch-bolt actuator; and a connecting device appended at the rear end of such latch-bolt case and forming a track for longitudinal motion of the retracting means, and having:

access means for effecting access of such actuator to the retracting means, for operative engagement of such actuator with the retracting means at either of said two selectable locations, and defining-and-receiving means, for defining two selectable positions longitudinally relative to such door edge and for receiving such latch-handle assembly mounting element at either of the two positions, to stabilize the connecting device with respect to such latch-handle assembly and such door;

said defining-and-receiving means comprising a configuration-selector plate that is movably mounted to the connecting device and that by exclusively longitudinal motion adapts the connecting device for use in either of the two standard backsets;

said connecting device also forming a track for said exclusively longitudinal motion of the configuration-selector plate;

the two selectable locations on said rear portion of the retracting means being mutually spaced apart longitudinally by a distance substantially equal to the difference between such two standard backsets; and the two selectable positions defined by the defining-and-receiving means being mutually spaced apart longitudinally by the same distance;

said connecting device limiting the exclusively longitudinal motion of the configuration-selector plate to an overall travel that is substantially equal to the same distance;

whereby the latch-bolt mechanism, by a single and exclusively longitudinal adjustment of the configuration-selector plate, can be adapted for installation using either of the standard backsets, without any mechanical modification of the mechanism, and without any adjustment or modification of such latch-bolt unit, latch-bolt case, or latch-handle assembly.

6. A duplex latch-bolt mechanism according to claim 5, wherein:

said retracting means comprise a plate-like member having:

a crosshead at its front end, a neck portion located at the rear end of the crosshead, a forked portion extending rearward from the neck portion, an arcuate stiffening rib provided on a connecting part of the forked portion, an elongated open section defined in the forward part of the forked portion, a clearing opening formed in the open section, and a pair of forward extraction teeth and a pair of rearward extraction teeth symmetrically located on an inner edge of the clearing opening; and said front portion of the retracting means is adapted for engagement with such extractor lever, as aforesaid, by means of said crosshead and said neck portion;

said rear portion of the retracting means is adapted for operative engagement with such actuator, as aforesaid, by either said forward or said rearward pair of extraction teeth selectably.

7. A duplex latch-bolt mechanism according to claim 5, wherein said connecting device comprises:

a first coupling member in the form of a generally flat plate-like piece having:

a mounting pin extending from its front side, a pair of anchoring tabs angularly located one at each side adjacent to a root end of the mounting pin, a forward screw opening and a rearward screw opening respectively provided in its forward portion, a forward clearing space and a rearward clearing space formed in its middle, and a pair of assembly-locking-tab notches and a screw opening located at its rear end;

a second coupling member that is a formed plate-like piece having:

a prong at its front end, a forward screw opening together with a coupling slot formed in its forward portion, a rearward screw opening together with a forward clearing space and a rearward clearing space provided in its middle portion, all corresponding to the screw openings and clearing spaces of the first coupling member, a pair of outwardly standing flanges, each formed along a respective opposite edge of the second coupling member, a pair of displacement notches located opposed to each other along the outer edge of each flange, a pair of outwardly standing assembly-locking tabs located opposed to each other, one at the rear end of the outer edge of each flange, and a pair of oblique bevels located opposed to each other, one cut into a front end of each flange;

said second coupling member being fixedly connected to the first coupling member, by virtue of the assembly-locking tabs of the second member being respectively secured in the assembly-locking-tab notches of the first coupling member; and a configuration-selector plate in the form of a generally flat, plate-like piece having:

a screw opening provided at its forward and rearward ends, a clearing space formed in its forward portion, corresponding to the forward and rearward clearing spaces of both the first and the second coupling members, and a pair of positioning tabs, each with a protuberance, located one along each of the opposite edges of the selector plate, for sliding motion in the respective displacement notches of the second coupling member, said selector plate being movably sandwiched beteen the first and the second coupling members;

whereby an extended pattern or a retracted pattern of the connecting device can be conveniently selected through shifting the position of the selector plate for altering configurations.

8. A duplex latch bolt mechanism according to claim 5, in further combination with such latch-handle assembly, and wherein:

the latch-handle assembly comprises a generally curved transfer member having said flat stiffening and actuating portion formed near its root area for operative engagement with selectably either the forward or rearward extraction teeth of the extracting means;

said flat portion being particularly adapted to clear the forward extraction teeth, over the full range of operation of the extractor lever, when engaged with the rearward extraction teeth.

9. The duplex latch-bolt mechanism of claim 1, further comprising:

such latch-bolt unit.

10. The duplex latch-bolt mechanism of claim 1, further comprising:

such latch-bolt unit; and such latch-bolt case.

11. The duplex latch-bolt mechanism of claim 1, further comprising:

such latch-bolt unit;

such latch-bolt case; and such latch-handle assembly.

12. The duplex latch-bolt mechanism of claim 5, further comprising:

such latch-bolt unit.

13. The duplex latch-bolt mechanism of claim 5, further comprising:

such latch-bolt unit; and such latch-bolt case.

14. The duplex latch-bolt mechanism of claim 5, further comprising:

such latch-bolt unit;

such latch-bolt case; and such latch-handle assembly.

* * * * *